US005246545A

United States Patent [19]

Ampulski et al.

[11] Patent Number: 5,246,545

[45] Date of Patent: Sep. 21, 1993

[54] PROCESS FOR APPLYING CHEMICAL PAPERMAKING ADDITIVES FROM A THIN FILM TO TISSUE PAPER

[75] Inventors: Robert S. Ampulski, Fairfield; Paul D. Trokhan, Hamilton, both of Ohio

[73] Assignee: Procter & Gamble Company, Cincinnati, Ohio

[21] Appl. No.: 936,161

[22] Filed: Aug. 27, 1992

[51] Int. Cl.[5] ..... D21H 21/22

[52] U.S. Cl. ..... 162/112; 162/113; 162/135; 162/136; 162/158; 162/206

[58] Field of Search ..... 162/111, 112, 113, 135, 162/136, 184, 158, 206, 207; 156/183; 264/282, 283

[56] References Cited

U.S. PATENT DOCUMENTS

| | | | |
|---|---|---|---|
| 2,309,089 | 1/1943 | Bauer et al. | 162/184 |
| 2,826,551 | 3/1958 | Geen | 252/89 |
| 3,301,746 | 1/1967 | Sanford et al. | 162/113 |
| 3,438,807 | 4/1969 | Pikula | 117/154 |
| 3,484,275 | 12/1969 | Lewicki | 117/93.4 |
| 3,755,071 | 8/1973 | Bey et al. | 162/184 |
| 3,812,000 | 5/1974 | Salvucci et al. | 162/111 |
| 3,814,096 | 6/1974 | Weiss et al. | 128/260 |
| 3,818,533 | 6/1974 | Scheuer | 15/104.93 |
| 3,964,500 | 6/1976 | Drakoff | 132/7 |
| 3,967,030 | 6/1976 | Johnson et al. | 428/266 |
| 3,974,025 | 8/1976 | Ayers | 162/113 |
| 3,994,771 | 11/1976 | Morgan, Jr. et al. | 162/113 |
| 4,028,172 | 6/1977 | Mazzarella | 162/164 R |
| 4,112,167 | 9/1978 | Dake et al. | 428/154 |
| 4,158,594 | 6/1979 | Becker et al. | 162/112 |
| 4,191,609 | 3/1980 | Trokhan | 162/113 |
| 4,300,981 | 11/1981 | Carstens | 162/109 |
| 4,355,021 | 10/1982 | Mahl et al. | 424/28 |
| 4,376,149 | 3/1983 | Martin | 428/266 |
| 4,395,454 | 7/1983 | Baldwin | 428/290 |
| 4,447,294 | 5/1984 | Osborn | 162/112 |
| 4,469,840 | 9/1984 | Alberts et al. | 524/500 |
| 4,481,243 | 11/1984 | Allen | 428/154 |
| 4,513,051 | 4/1985 | Lavash | 428/212 |
| 4,637,859 | 1/1987 | Trokhan | 162/109 |
| 4,795,530 | 1/1989 | Soerens et al. | 162/11 |
| 4,940,513 | 7/1990 | Spendel | 162/112 |
| 4,950,545 | 8/1990 | Walter et al. | 428/446 |
| 4,959,125 | 9/1990 | Spendel | 162/158 |
| 5,059,282 | 10/1991 | Ampulski et al. | 162/111 |
| 5,164,046 | 11/1992 | Ampulski et al. | 162/111 |

FOREIGN PATENT DOCUMENTS

| | | | |
|---|---|---|---|
| 899223 | 5/1972 | Canada . | |
| 0144658 | 6/1985 | European Pat. Off. . | |
| 0213596 | 3/1987 | European Pat. Off. . | |
| 347153 | 12/1989 | European Pat. Off. | 162/112 |
| 3420940 | 1/1985 | Fed. Rep. of Germany . | |

*Primary Examiner*—Peter Chin

*Attorney, Agent, or Firm*—Bart S. Hersko; Fredrick H. Braun

[57] ABSTRACT

Disclosed is a process for making soft tissue paper which includes providing a dry tissue web and then applying a sufficient amount of a chemical papermaking additive from a thin film to the dry web. The chemical papermaking additives are added to the surface of the tissue paper to enhance properties of the paper such as strength, softener, absorbency, and/or aesthetics. The chemical papermaking additive application process includes the steps of diluting the chemical papermaking additive with a suitable solvent, applying the diluted chemical solution to a heated transfer surface, evaporating the solvent from the dilute solution to form a film, and then transferring the film to the tissue by contacting the dry tissue web with the heated transfer surface. Preferably, the tissue web is dried to a moisture level below its equilibrium moisture content before application of the papermaking additive.

21 Claims, 1 Drawing Sheet

PROCESS FOR APPLYING CHEMICAL PAPERMAKING ADDITIVES FROM A THIN FILM TO TISSUE PAPER

TECHNICAL FIELD

This invention relates, in general, to a process for preparing tissue paper; and more specifically, to a process for applying low levels of chemical papermaking additives to the surface of tissue paper for enhancing the properties of the paper, e.g., strength, softness, absorbency, and/or aesthetics.

BACKGROUND OF THE INVENTION

Consumer products such as toilet tissue, toweling and facial tissue made from cellulosic webs are a pervasive part of modern society. In general, these products need to possess certain key physical properties to be considered acceptable to consumers. While the exact mix of key properties and the absolute value of the individual properties will vary depending on the nature of the product, nonetheless, softness, wet and dry strength, absorbency, and pleasing aesthetic nature are universally desirable properties. Softness is that aspect of the fibrous web that elicits a pleasing tactile response and insures that the product is not harsh or abrasive when it contacts human skin or other fragile surfaces. Strength is the ability of the structure to retain its physical integrity during use. Absorbency is the property of the fibrous structure which allows it top acquire and retain contacted fluids in an acceptable time. Aesthetic nature refers to the psycho-visual response that occurs when the consumer views the product either alone or in the context of the product's surroundings.

The most common method for the manufacture of tissue products is the wet laid papermaking process. In such a process, individual fibers are first suspended in a dilute slurry with water. This slurry is then laid on a foraminous to remove a large portion of the water and to form a thin, relatively uniform-weight embryonic web. This embryonic web is then molded and/or dried in a variety of ways to form the final tissue web. As part of this process the molded and/or dried web is usually glued to a drying drum and subsequently creped from the surface of the dryer to impart desirable properties.

Products made by many existing wet laid processes fall under the above description. Examples of such webs that are soft, strong, and absorbent and contain at least two micro regions of density can be found in, U.S. Pat. Nos.: 3,301,746 which issued Jan. 31, 1967, to Lawrence H. Sanford and James B. Sisson; 3,974,025 which issued Aug. 10, 1976, to Peter G. Ayers; 3,994,771 which issued Nov. 30, 1976, to George Morgan, Jr. and Thomas F. Rich; 4,191,609 which issued Mar. 4, 1980, to Paul D. Trokhan; and 4,637,859 which issued Jan. 20, 1987, to Paul D. Trokhan. Each of these papers is characterized by a repeating pattern of dense areas and less dense areas The dense areas can be either discrete or continuous. These dense areas result from localized compaction of the web during papermaking by raised areas of an imprinting carrier fabric or belt.

Other high-bulk, soft tissue papers are disclosed in U.S. Pat. No. 4,300,981 which issued Nov. 17, 1981, to Jerry E. Carstens; and 4,440,597 which issued Apr. 3, 1984, to Edward R. Wells and Thomas A. Hensler.

Additionally, achieving high-bulk, soft and absorbent tissue paper through the avoidance of overall compaction prior to final drying is disclosed in U.S. Pat. No. 3,821,068 which issued Jun. 28, 1974, to D. L. Shaw; and avoidance of overall compaction in combination with the use of debonders and elastomeric bonders in the papermaking furnish is disclosed in U.S. Pat. No. 3,812,000 which issued May 21, 1974, to J. L. Salvucci, Jr.

Chemical debonders such as those contemplated by Salvucci, referred to above, and their operative theory are disclosed in such representative U.S. Pat. Nos. as 3,755,220 which issued Aug. 28, 1973, to Friemark et al.; 3,844,880 which issued Oct. 29, 1974, to Meisel et al.; and 4,158,594 which issued Jan. 19, 1979, to Becker et al.

Tissue paper has also been treated with cationic surfactants, as well as noncationic surfactants to enhance softness. See, for example, U.S. Pat. No. 4,959,125 which issued Sep. 25, 1990, to Spendel; and U.S. Pat. No. 4,940,513 which issued Jul. 10, 1990, to Spendel, that disclose processes for enhancing the softness of tissue paper by treating it with noncationic, preferably nonionic, surfactants.

It has been found that the softness of tissue paper, in particular, high-bulk pattern densified tissue papers, can be improved by treatment with various agents such as vegetable, animal or synthetic oils, and especially polysiloxane materials typically referred to as silicone oils. See, for example, U.S. Pat. No. 5,059,282 which issued Oct. 22, 1991, to Ampulski et al. The Ampulski patent discloses a process for adding a polysiloxane compound to a wet tissue web (preferably at a fiber consistency of between about 20% and about 35%). These polysiloxane compounds impart a silky, soft feeling to the tissue paper.

While the processes described above generally make acceptable product properties, the product properties can be further enhanced. However, processes to make current products and potentially enhanced products suffer from several drawbacks. For example, the chemicals used to strengthen tissue webs are often added to the dilute slurry of water and fibers prior to the initial lay down on the forming screen. This is a relatively convenient and cost effective way to introduce additives. However, other chemicals to aid absorbency or to improve softness are also commonly added to the so called wet end of the tissue making process. Because of the complex nature of the individual chemicals used to generate the key properties, they often interact with each other in an adverse manner. They can compete with each other for the desired retention on the cellulose fibers as well as destroy properties that are inherent in the fibers. For example softening chemicals often reduce the natural tendency of fibers to bond to other fibers and hence reduce the functional strength of the resulting web. Both the process and the product benefit if the chemical papermaking additives introduced in the wet end are kept to a minimum.

As previously mentioned, the majority of the existing tissue manufacturing processes glue the web to the surface of a drying drum and subsequently crepe the web from the dryer surface Creping generally produces a web with improved softness and importantly improves the extensibility of the web. For proper creping to occur, it is imperative that the web be securely attached to the surface of the drum. Many of the chemicals added to the wet end of the machine, to ostensibly improve key properties, end up interfering with the adhesion of the web to the drying drum and hence adversely affect the creping process and the quality of the tissue produced. The creping operation runs optimally when the adhesive used to adhere the web to the creping surface is free of interference from non-creping related chemicals such as those added at the wet end of the overall tissue making process.

Additives introduced in the wet end of the process must be retained by the cellulose fibers if the chemicals are to be functional. This is generally done by using chemicals that possess an ionic charge; most preferably a positive ionic charge which is attracted to the inherent negative ionic charge of cellulose. Many additives which could improve the properties of the web are not charged. Introduction of such chemicals into the dilute fiber slurry at the wet end of the process results in poor retention and exacerbates the interference problems described above.

Another drawback to adding any chemical to the wet end of the process is that the chemical, if retained, is distributed throughout the web. In many instances it is desirable to apply active ingredient(s) only to the surface of the web. This may, for instance, be desirable with lubricious softening materials. Application only to the surface insures efficient use of the material since consumers only tactically interact with the surface. Application to the surface also avoids interference with other materials, such as strength additives, that might best be included in the center of the sheet. The present invention overcomes all of the above mentioned drawbacks and generates desirable additional benefits.

It is therefore, an object of this invention to provide an improved process to incorporate chemical papermaking additives into the tissue web that enhance softness, strength, absorbency, and aesthetics or combinations of these properties.

It is a further object of this invention to provide an improved process to incorporate chemical papermaking additives into the tissue web that enhance softness, strength, absorbency, and aesthetics, or combinations of these properties, without interference with the creping operation or disruption of the delicate water system balance or loss of beneficial properties generated by other means.

It is a further object of this invention to provide an improved process to incorporate chemical papermaking additives into the tissue web that are typically poorly retained when added at the wet end of the papermaking process.

It is a further object of this invention to provide a process for adding chemical papermaking additives to the dry web at the calender stack.

It is a further object of this invention to provide an improved process to apply diluted chemical papermaking additives (diluted to insure controlled application of small quantities of additive) to a heated transfer surface, to preferentially evaporate the solvent or carrier material while the mixture is on the transfer surface but prior to addition to the dry web and subsequently to apply a more concentrated mixture of the additive and solvent to the surface of the tissue web than was initially applied to the transfer surface.

It is a further object of this invention to provide an improved process to apply chemical papermaking additives to the tissue web via the process described above where the vapor pressure of the carrier or solvent material is higher than that of the additive material such that the carrier is preferentially depleted after application to the heated transfer surface. Preferably this carrier depletion also occurs prior to application to the tissue web.

These and other objects are obtained using the present invention, as will be seen from the following more detailed disclosure.

SUMMARY OF THE INVENTION

The present invention encompasses a process for making soft, strong, absorbent, and aesthetically pleasing tissue paper. This process includes the steps of providing a dry tissue paper web and then applying a sufficient amount of a chemical papermaking additive to the dry web. More specifically, the softener application process includes the steps of diluting a chemical papermaking additive compound with a suitable solvent to form a diluted papermaking additive solution; applying the diluted papermaking additive solution to a heated transfer surface by, for example, spraying; and evaporating a portion of the solvent from the heated transfer surface to form a film containing the papermaking additive. Next, at least one outwardly-facing surface of the dry tissue paper web is contacted with the heated transfer surface resulting in a transfer of a sufficient amount of the papermaking additive such that between 0.004% and about 2% of the papermaking additive is retained by the tissue paper. By solvent is meant a fluid that completely dissolves a chemical papermaking additive, or a fluid that is used to emulsify a chemical papermaking additive, or a fluid that is used to suspend a chemical papermaking additive The solvent may also be a carrier or delivery vehicle that contains the chemical additive or aids in the delivery of chemical papermaking additive. All references are meant to be interchangeable and not limiting. The solution is the fluid containing the chemical papermaking additive By solution is meant a true solution, an emulsion, and/or suspension. For purposes for this invention, all terms are interchangeable and not limiting. If the solvent is water then, preferably, the hot web is dried to a moisture level below its equilibrium moisture content (at standard conditions) before being contacted with the papermaking additive film, however this process is also applicable to tissue paper at its equilibrium moisture as well, if most of the water is evaporated from the transfer surface.

The amount of papermaking additive retained by the tissue paper is preferably, between 0.01% to about 1.0%, based on the dry fiber weight of the tissue paper. The resulting tissue paper preferably has a basis weight of from about 10 to about 80 g/m$^2$ and a fiber density of less than about 0.6 g/cc.

As mentioned above, the papermaking additive is applied to the web preferably, after the web has been dried and creped By adding the papermaking additive to the web after drying and creping, there is no interference with the glue on the Yankee dryer, which can cause skip crepe and/or loss in sheet control. Further, papermaking additives applied by means of the process described in this invention do not interfere with the papermaking water system, since they are not added in the wet end of the paper machine. A further advantage of this process is that the additives do not need to be substantive to the paper. That is, they do not need to contain a cationic charge for bonding with the anionic charge on the cellulosic papermaking fibers. Preferably, the papermaking additive is applied to a hot, creped web after it leaves the doctor blade and before it is wound on the parent roll.

Surprisingly, it has been found that significant tissue softening, strength, absorbency, and/or aesthetic benefits can be achieved by low levels of a chemical papermaking additive when the papermaking additive is diluted with a solvent, applied to a heated transfer surface which evaporates the carrier solvent and then transfers the papermaking additive to a hot web before the converting operation. An advantage of the process disclosed herein, is that the amount of residual solvent transferred to the paper web is sufficiently low that it does not degrade other product properties. In addition, the quantity of papermaking additive used is low enough to be economical. Also, tissue paper treated with low levels of chemical softeners, such as polysiloxanes, retain a high level of wettability, an important feature for a tissue product.

Preferred softener additives for use in the process of the present invention include an amino-functional polydimethylpolysiloxane wherein less than about 10 mole percent of the side chains on the polymer contain an amino-functional group. In addition to such substitution with amino-functional groups, effective substitution may be made with carboxyl, hydroxyl, ether, polyether, aldehyde, ketone, amide, ester, and thiol groups. Of these effective substituent groups, the family of groups comprising amino, carboxyl, and hydroxyl groups are more preferred than the others; and amino-functional groups are most preferred.

Exemplary commercially available polysiloxanes include DOW 8075 and DOW 200 which are available from Dow Corning; and Silwet L72O and Ucarsil EPS which are available from Union Carbide.

Other preferred softener additives suitable for the present invention include nonionic surfactants selected from sorbitan esters, ethoxylated sorbitan esters, propoxylated sorbitan esters, mixed ethoxylated/propoxylated sorbitan esters, and mixtures thereof.

The process for preparing tissue paper treated with a chemical softener additive such as the polysiloxane and/or nonionic surfactants discussed above may further comprise the step of adding an effective amount of an absorbency additive to enhance the tactile perceivable surface smoothness of the tissue paper and/or to at least partially offset any reduction of wettability the tissue paper which would otherwise result from the incorporation of the polysiloxane or other chemical softener. Of course, the wettability of the paper without the chemical softener additive can be enhanced with the addition of a suitable absorbency additive such as a surfactant. The effective amount of surfactant is such that, preferably, from about 0.01 to about 2 percent on a dry fiber weight of the tissue paper; and, more preferably, from about 0.05 to about 1.0 percent is retained by the tissue paper. Also, preferably, the surfactant is noncationic; and is substantially nonmigratory in situ after the tissue paper has been manufactured in order to substantially obviate post-manufacturing changes in the tissue paper's properties which might otherwise result from the inclusion o surfactant. This may be achieved, for instance, through the use of surfactants having melt temperatures greater than the temperatures commonly encountered during storage, shipping, merchandising, and use of tissue paper product embodiments of the invention: for example, melt temperatures of about 50° C. or higher.

Also, the process for preparing tissue paper in accordance with the present invention may further comprise the step of adding an effective amount of a strength additive such as a starch-based material to at least partially offset any reduction of tensile strength and/or increase in linting propensity which would otherwise result from the incorporation of the chemical softener additive and, if present, absorbency additive. The effective amount of strength additive is such that, preferably, from about 0.01 to about 2 percent on a dry fiber weight basis of the tissue paper, is retained by the tissue paper.

All percentages, ratios and proportions herein are by weight, unless otherwise specified.

BRIEF DESCRIPTION OF THE INVENTION

FIG. 1 is a schematic representation illustrating a preferred embodiment of the process of the present invention of adding chemical papermaking additive compounds to a tissue web.

The present invention is described in more detail below.

DETAILED DESCRIPTION OF THE INVENTION

Figure 1:
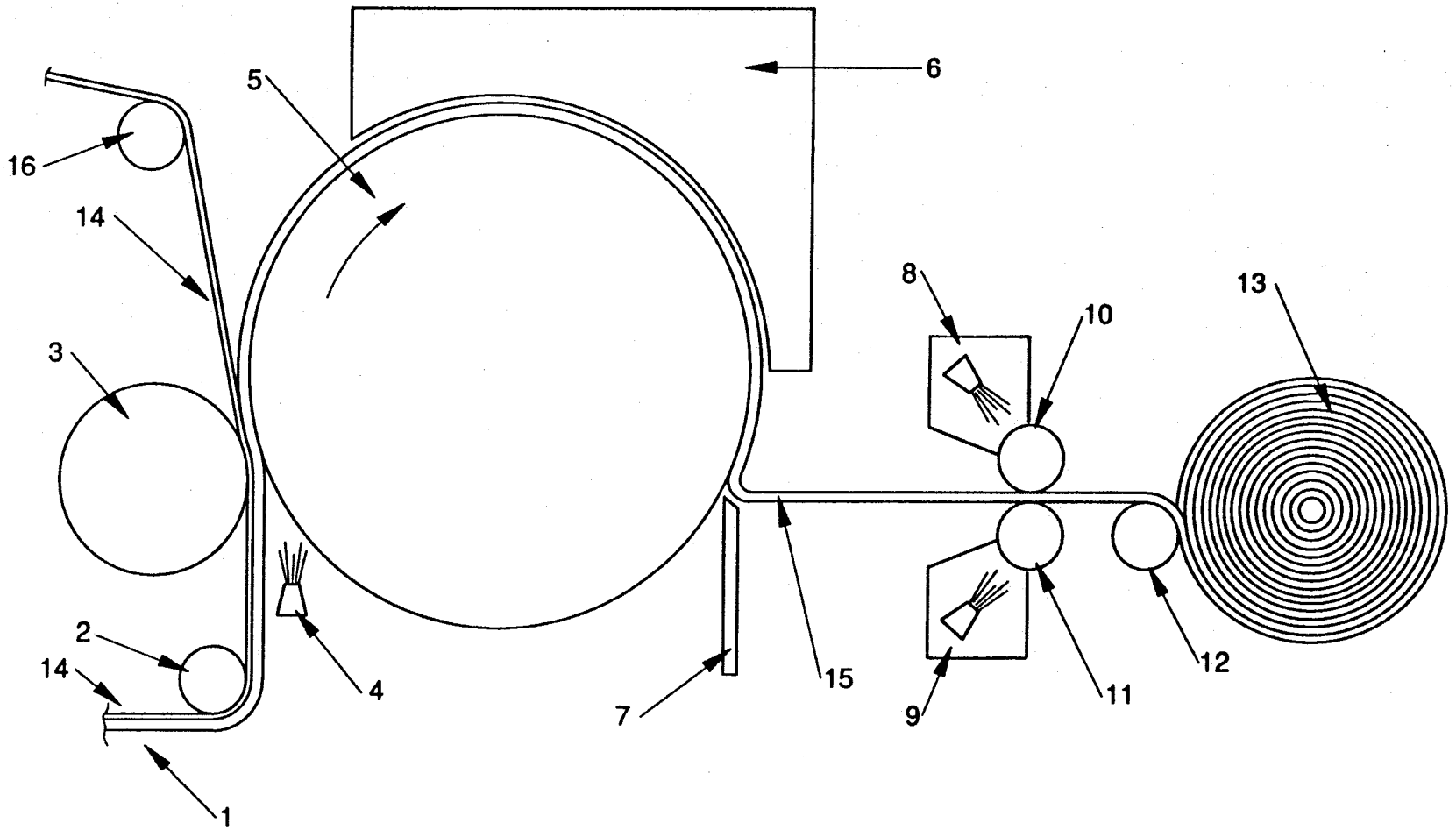

Briefly, the present invention provides tissue paper having enhanced tactile perceivable softness through the addition of a chemical softener additive, improved strength through the addition of a strength additive, enhanced absorbency through the addition of an absorbency additive, and/or enhanced aesthetics by incorporating an aesthetic additive such as inks, dyes, and perfumes to a dry tissue web. These properties can be enhanced by applying these and other chemical papermaking additives alone or in combination to a dry tissue web. Preferably, the tissue web is dried to a moisture content below its equilibrium moisture content before the chemical papermaking additive is applied to the web.

Surprisingly, it has been found that very low levels of chemical additives, e.g. polysiloxane softeners provide a significant tissue softening effect when applied to dry tissue webs in accordance with the present invention. Importantly, it has been found that the levels of softener additives used to soften the tissue paper are low enough that the tissue paper retains high wettability. Furthermore, because the tissue web is preferably overdried and at an elevated temperature when the papermaking additive is applied and because carrier water is depleted on the hot transfer surface, further drying is not required.

As used herein, hot tissue web refers to a tissue web which is at an elevated temperature that is higher than room temperature. Preferably the elevated temperature of the web is at least 43° C., and more preferably at least 65° C.

The moisture content of a tissue web is related to the temperature of the web and the relative humidity of the environment in which the web is placed. As used herein, the term "overdried tissue web" refers to a tissue web that is dried to a moisture content below its equilibrium moisture content at standard test conditions of 23° C. and 50% relative humidity. The equilibrium moisture content of a tissue web placed in standard testing conditions of 23° C. and 50% relative humidity is approximately 7%. The tissue web in the present invention can be overdried by raising it to a elevated temperature through use of conventional drying means such as a Yankee dryer. Preferably, an overdried tissue web will have a moisture content of less than 7%, more preferably from about 0 to about 6%, and most preferably, a moisture content of from about 0 to about 3%, by weight.

Paper exposed to the normal environment typically has an equilibrium moisture content in the range of 5 to 8%. When paper is dried and creped the moisture content in the sheet is generally less than 3%. After manufacturing, the paper absorbs water from the atmosphere. In the preferred process of the present invention, advantage is taken of the low moisture content in the paper as it leaves the doctor blade. By applying a chemical papermaking additive solution on the paper while it is overdried, any residual water that is added to the paper is less than what would normally be taken up from the atmosphere. Thus, no further drying is required, and no tensile loss is observed other than that which would normally occur if the paper were absorbing moisture from the air.

The present invention is applicable to tissue paper in general, including but not limited to conventionally felt-pressed tissue paper; pattern densified tissue paper such as exemplified by Sanford-Sisson and its progeny; and high-bulk, uncompacted tissue paper such as exemplified by Salvucci. The tissue paper may be of a homogenous or multilayered construction; and tissue paper products made therefrom may be of a single-ply or multi-ply construction. The tissue paper preferably has a basis weight of between 10 g/m$^2$ and about 80 g/m$^2$, and density of about 0.60 g/cc or less. Preferably, basis weight will be below about 35 g/m$^2$ or less; and density will be about 0.30 g/cc or less. Most preferably, density will be between 0.04 g/cc and about 0.20 g/cc.

Conventionally pressed tissue paper and methods for making such paper are known in the art. Such paper is typically made by depositing papermaking furnish on a foraminous forming wire. This forming wire is often referred to in the art as a Fourdrinier wire. Once the furnish is deposited on the forming wire, it is referred to as a web. The web is dewatered by pressing the web and drying at elevated temperature. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 45% (total web weight basis) by vacuum dewatering and further dried by pressing operations wherein the web is subjected to pressure developed by opposing mechanical members, for example, cylindrical rolls. The dewatered web is then further pressed and dried by a stream drum apparatus known in the art as a Yankee dryer. Pressure can be developed at the Yankee dryer by mechanical means such as an opposing cylindrical drum pressing against the web. Multiple Yankee dryer drums may be employed, whereby additional pressing is optionally incurred between the drums. The tissue paper structures which are formed are referred to hereinafter as conventional, pressed, tissue paper structures. Such sheets are considered to be compacted, since the web is subjected to substantial overall mechanical compressional forces while the fibers are moist and are then dried while in a compressed state.

Pattern densified tissue paper is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Peter G. Ayers on Aug. 10, 1976, and U.S. Pat. No. 4,191,609, issued to Paul D. Trokhan on Mar. 4, 1980, and U.S. Pat. No. 4,637,859, issued to Paul D. Trokhan on Jan. 20, 1987; all of which are incorporated herein by reference.

In general, pattern densified webs are preferably prepared by depositing a papermaking furnish on a foraminous forming wire such as a Fourdrinier wire to form a wet web and then juxtaposing the web against an array of supports The web is pressed against the array of supports, thereby resulting in densified zones in the web at the locations geographically corresponding to the points of contact between the array of supports and the wet web. The remainder of the web not compressed during this operation is referred to as the high-bulk field. This high-bulk field can be further dedensified by application of fluid pressure, such as with a vacuum type device or a blow-through dryer, or by mechanically pressing the web against the array of supports. The web is dewatered, and optionally predried, in such a manner so as to substantially avoid compression of the high-bulk field. This is preferably accomplished by fluid pressure, such as with a vacuum type device or blow-through dryer, or alternately by mechanically pressing the web against an array of supports wherein the high-bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 65% of the tissue paper surface comprises densified knuckles having a relative density of at least 125% of the density of the high-bulk field.

The array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, Sanford and Sisson, issued Jan. 31, 1967, U.S. Pat. No. 3,821,068, Salvucci, Jr. et al., issued May 21, 1974, U.S. Pat. No. 3,974,025, Ayers, issued Aug. 10, 1976, U.S. Pat. No. 3,573,164, Friedberg et al., issued Mar. 30, 1971, U.S. Pat. No. 3,473,576, Amneus, issued Oct. 21, 1969, U.S. Pat. No. 4,239,065, Trokhan, issued Dec. 16, 1980, and U.S. Pat. No. 4,528,239, Trokhan, issued Jul. 9, 1985, all of which are incorporated herein by reference.

Preferably, the furnish is first formed into a wet web on a foraminous forming carrier, such as a Fourdrinier wire. The web is dewatered and transferred to an imprinting fabric. The furnish may alternately be initially deposited on a foraminous supporting carrier which also operates as an imprinting fabric. Once formed, the wet web is dewatered and, preferably, thermally predried to a selected fiber consistency of between about 40% and about 80%. Dewatering is preferably performed with suction boxes or other vacuum devices or with blow-through dryers. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Uncompacted, nonpattern-densified tissue paper structures are described in U.S. Pat. No. 3,812,000 issued to Joseph L. Salvucci, Jr. and Peter N. Yiannos on May 21, 1974, and U.S. Pat. No. 4,208,459, issued to Henry E. Becker, Albert L. McConnell, and Richard Schutte on Jun. 17, 1980, both of which are incorporated herein by reference. In general, uncompacted, nonpattern-densified tissue paper structures are prepared by depositing a papermaking furnish on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high-bulk sheet of relatively uncompacted fibers. Bonding material is preferably applied to portions of the web prior to creping.

Compacted non-pattern-densified tissue structures are commonly known in the art as conventional tissue structures. In general, compacted, non-pattern-densified tissue paper structures are prepared by depositing a papermaking furnish on a foraminous wire such as a Fourdrinier wire to form a wet web, draining the web and removing additional water with the aid of a uniform mechanical compaction (pressing) until the web has a consistency of 25–50%, transferring the web to a thermal dryer such as a Yankee and creping the web. Overall, water is removed from the web by vacuum, mechanical pressing and thermal means. The resulting structure is strong and generally of singular density, but very low in bulk, absorbency and in softness.

The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex TM, available from Hercules, Inc. (Wilmington, Del.).

Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

In addition to papermaking fibers, the papermaking furnish used to make tissue paper structures may have other components or materials added thereto as may be or later become known in the art. The types of additives desirable will be dependent upon the particular end use of the tissue sheet contemplated. For example, in products such as toilet paper, paper towels, facial tissues and other similar products, high wet strength is a desirable attribute. Thus, it is often desirable to add to the papermaking furnish chemical substances known in the art as "wet strength" resins.

A general dissertation on the types of wet strength resins utilized in the paper art can be found in TAPPI monograph series No 29, Wet Strength in Paper and Paperboard, Technical Association of the Pulp and Paper Industry (N.Y., 1965) The most useful wet strength resins have generally been cationic in character. Polyamide-epichlorohydrin resins are cationic wet strength resins which have been found to be of particular utility. Suitable types of such resins are described in U.S. Pat. Nos 3,700,623, issued on Oct. 24, 1972, and 3,772,076, issued on Nov. 13, 1973, both issued to Keim and both being hereby incorporated by reference. One commercial source of a useful polyamide-epichlorohydrin resins is Hercules, Inc. of Wilmington, Del., which markets such resin under the mark Kymeme TM 557H.

Polyacrylamide resins have also been found to be of utility as wet strength resins These resins are described in U.S. Pat. Nos. 3,556,932, issued on Jan. 19, 1971, to Coscia, et al. and 3,556,933, issued on Jan. 19, 1971, to Williams et al., both patents being incorporated herein by reference. One commercial source of polyacrylamide resins is American Cyanamid Co. of Stanford, Conn., which markets one such resin under the mark Parez TM 631 NC.

Still other water-soluble cationic resins finding utility in this invention are urea formaldehyde and melamine formaldehyde resins The more common functional groups of these polyfunctional resins are nitrogen containing groups such as amino groups and methylol groups attached to nitrogen. Polyethylenimine type resins may also find utility in the present invention. In addition, temporary wet strength resins such as Caldas (manufactured by Japan Carlit) and CoBond 1000 (manufactured by National Starch and Chemical Company) may be used in the present invention. It is to be understood that the addition of chemical compounds such as the wet strength and temporary wet strength resins discussed above to the pulp furnish is optional and is not necessary for the practice of the present development.

In the process of the current invention the chemical papermaking additives are applied after the tissue web has been dried and creped, and preferably is still at an elevated temperature. It has been found that addition of some chemical papermaking additives to the tissue web before the web is dried and creped can result in interference with the coating on the dryer (i.e., glue coating on Yankee dryer), and also cause skip crepe and a loss in sheet control. These problems are eliminated by the process of the present invention wherein the chemical papermaking additives are applied to the web after the web has been dried and creped. Preferably, the chemical papermaking additives are applied to the dried and creped tissue web before the web is wound onto the parent roll. Thus, in a preferred embodiment of the present invention the chemical papermaking additives are applied to a hot, overdried tissue web after the web has been creped, but before the web passes through the calender rolls.

The chemical papermaking additives are preferably applied to the hot transfer surface from an aqueous solution, emulsion, or suspension. The chemical papermaking additives can also be applied in a solution containing a suitable, nonaqueous solvent, in which the chemical papermaking additive dissolves or with which the chemical papermaking additive is miscible: for example, hexane. The chemical papermaking additive may be supplied in neat form or, more preferably, emulsified with a suitable surfactant emulsifier. Emulsified chemical papermaking additives are preferable for ease of application since a neat chemical papermaking additive aqueous solution must be agitated to inhibit separation into water and chemical papermaking additive phases.

The chemical papermaking additive should be applied to the heated transfer surface in a macroscopically uniform fashion for subsequent transfer to the tissue paper web so that substantially the entire sheet benefits from the effect of the chemical papermaking additive. Following application to the heated transfer surface, the solvent preferably evaporates leaving a thin film containing the chemical papermaking additive. By thin film is meant any thin coating, haze or mist on the transfer surface. This thin film can be microscopically continuous, discrete or patterned, but should be macroscopically uniform. On a microscopic scale the chemical papermaking additive may be distributed in a uniform, random, discrete, patterned, continuous, or discontinuous fashion Applying the chemical papermaking additive to the tissue paper web in continuous and patterned distributions are both within the scope of the invention and meet the above criteria. Likewise, the chemical papermaking additive can be added to either side of the tissue web singularly, or to both sides.

Methods of macroscopically uniformly applying the chemical papermaking additive to the hot transfer surface include spraying and gravure printing. Spraying has been found to be economical, and susceptible to accurate control over quantity and distribution of the chemical papermaking additive, so it is most preferred. Preferably, an aqueous mixture containing an emulsified chemical papermaking additive is applied from the transfer surface onto the dried, creped tissue web after the Yankee dryer and before the parent roll.

FIG. 1 illustrates a preferred method of applying the chemical papermaking additive to the tissue web. Referring to FIG. 1, a wet tissue web 1 is on carrier fabric 14 past turning roll 2 and transferred to Yankee dryer 5 by the action of pressure roll 3 while carrier fabric 14 travels past turning roll 16. The paper web is adhesively secured to the cylindrical surface of Yankee dryer 5 by adhesive applied by spray applicator 4. Drying is completed by steam-heated Yankee dryer 5 and by hot air which is heated and circulated through drying hood 6 by means not shown. The web is then dry creped from the Yankee dryer 5 by doctor blade 7, after which it is designated creped paper sheet 15. An aqueous mixture containing an emulsified chemical papermaking additive compound is sprayed onto an upper heated transfer surface designated as upper calender roll 10 and/or a lower heated transfer surface designated as lower calender roll 11, by spray applicators 8 and 9 depending on whether the chemical papermaking additive is to be applied to both sides of the tissue web or just to one side. The paper sheet 15 then contacts heated transfer surfaces 10 and 11 after a portion of the solvent has been evaporated. The treated web then travels over a circumferential portion of reel 12, and then is wound onto parent roll 13. Equipment suitable for spraying chemical papermaking additive-containing liquids onto hot transfer surfaces include external mix, air atomizing nozzles, such as the 2 mm nozzle available from V.I.B. Systems, Inc., Tucker, Ga. Equipment suitable for printing chemical papermaking additive-containing liquids onto hot transfer surfaces include rotogravure or flexographic printers.

While not wishing to be bound by theory or to otherwise limit the present invention, the following description of typical process conditions encountered during the papermaking operation and their impact on the process described in this invention is provided. The Yankee dryer raises the temperature of the tissue sheet and removes the moisture. The steam pressure in the Yankee is on the order of 110 PSI (750kPa). This pressure is sufficient to increase the temperature of the cylinder to about 173° C. The temperature of the paper on the cylinder is raised as the water in the sheet is removed. The temperature of the sheet as it leaves the doctor blade can be in excess of 120° C. The sheet travels through space to the calender and the reel and loses some of this heat. The temperature of the paper wound in the reel is measured to be on the order of 65° C. Eventually the sheet of paper cools to room temperature. This can take anywhere from hours to days depending on the size of the paper roll. As the paper cools it also absorbs moisture from the atmosphere. As previously mentioned, the moisture content in the sheet is related to the sheet temperature and the relative humidity of the environment in which the paper is placed. For example the equilibrium moisture content of a sheet placed in standard testing conditions of 23° C. and 50% RH is approximately 7%. Increasing the moisture content of the sheet above 7% can have a deleterious effect on the tensile strength of the paper. For example, a moisture increase to 9% can cause the tensile strength of the paper to decrease by as much as 15%.

One very surprising attribute of chemical softeners, such as polysiloxane, is their ability to improve softness at very low levels on the surface of the paper. The chemical softener, however needs to be fairly uniformly distributed on the paper surface in order for the consumer to recognize the improved softness From a process standpoint, there was previously no satisfactory method of uniformly applying low quantities of a chemical softener to a paper web traveling at a high rate of speed. Belt speeds of 700 to 1000 meters/minute (25 to 40 miles/hour) are typical in modern high speed paper machines. Webs traveling at these rates of speed generally have an air boundary layer on their surface. One method for applying low quantities of liquids is to use a spray system and adjust the air and/or liquid pressures. For example, one could go to low flow rates by using high air pressures. This generally produces extremely small particles. It is difficult to impart sufficient momentum into these small particles so they can penetrate the air boundary layer traveling on the surface of the fast moving paper web. Moreover, if one increases the particle size of the spray fluid so it can penetrate the air boundary layer at low flow rates the surface coverage becomes nonuniform.

One commonly used method for applying low levels of an active material is to first dilute the material with a solvent. The spray systems can then be adjusted to deliver larger particle sizes at high flow rates. The larger particles can penetrate the air boundary layer. However one is now faced with the problem of having to remove the solvent from the paper. Generally volatile organic solvents are not used in papermaking, since they can be fire or environmental hazards. Water can be used as a solvent for water soluble papermaking additives. Water can also be used as a solvent, or more appropriately as a diluent, for the non-water soluble papermaking additives, such as organic oils, polymers, and polysiloxanes, if the non-water soluble papermaking additive, such as a polysiloxane is first emulsified with a suitable surfactant system. While water does not pose the same process risks as an organic solvent, water can degrade the product, causing a loss in crepe and/or tensile strength. Further the water needs to be removed from the paper.

One remedy to the water problem is to apply a dilute chemical papermaking additive to the paper while it is overdried. The water added to the paper with the chemical papermaking additive by this method is usually less than the paper would normally take up from the atmosphere upon cooling to room temperature. Thus, no further drying is required, and no loss in tensile strength occurs from addition of the water. However, the water solution is capable of penetrating the entire sheet causing the active material to spread to the inside of the sheet rather than staying on the surface of the paper where it is most effective. Further, this process is limited to an overdried sheet, making application to the paper during a converting process (an off paper machine process) difficult without adding an additional drying step to the process. A further limitation to this process is the limited dilution range and application range of the chemical papermaking additive emulsion imposed by the emulsion properties, (i.e., high concentrations tend to have high viscosities, whereas low concentrations increase the amount of water sprayed on the sheet).

The present invention solves the above described problems by first spraying a dilute water soluble chemical papermaking additive or emulsified non-water soluble chemical papermaking additive solution onto a hot transfer surface and evaporating the solvent from the chemical papermaking additive solution before transferring it to the dry web.

For exemplary purposes, a typical commercially available silicone emulsion chemical softener is Dow Corning® Q2-7224 Conditioning Agent marketed by the Dow Corning Corporation. This material generally contains about 35% by weight of an amino-functional polysiloxane emulsified in water. This silicone receipt emulsion is diluted with water to less than about 20% concentration, by weight, before being applied to the h ated transfer surface More preferably, chemical papermaking additive emulsions used in the present invention are first diluted with water to less than about 15% concentration by weight before being applied to the transfer surface.

Exemplary materials suitable for the heated transfer surfaces include metal (e.g., steel, stainless steel, and chrome), non-metal (e.g., suitable polymers, ceramic, glass), and rubber.

When a diluted silicone emulsion of the type described above was sprayed on the hot transfer surface, in this case a steel calender roll, it was most surprising to discover that little or no water was transferred to the paper web by this process. In fact, under one set of process conditions, it was expected that the sheet moisture content would increase from a base of 4% to 5% after spraying. However, it was found that the moisture content did not increase at all, while the silicone content in the web did increase to its expected concentration. It was a further surprise to find that an attempt to increase the sheet moisture by 3.5% (i.e., raising the sheet moisture from 4 to 7.5%) only resulted in a moisture increase of 0.7%, that is the measured moisture content was only 4.7%.

This is most surprising since the roll temperature is on the order of 80° C. (20° C. below the boiling point of water) and the time between the point of application and point of transfer is on the order of 0.1 sec. It was surprising to discover that greater than 50% of the water had evaporated from the roll under these conditions, leaving behind a thin film of polysiloxane emulsion. This thin film was calculated to be on the order of 0.25 microns thick (1 micron = $10^{-6}$ meters) The films of the present invention are preferably less than about 10 microns in thickness, and more preferably, less than about one micron in thickness.

In the process of the present invention it is preferred that at least about 50%, more preferably at least about 80%, of the water is evaporated from the dilute chemical papermaking additive solution which is applied to the heated transfer surface before transferring it to the dry tissue web. This leaves a film with a calculated thickness of about 0.075 microns. Most preferably greater than about 95% of the water is evaporated from the solution on the heated transfer surface, leaving a calculated film thickness of about 0.05 microns for transfer to the paper web.

The temperature of the heated transfer surface is preferably below the boiling point of the solvent. Thus, if the solvent is water, the temperature of the heated transfer surface should be below 100° C. Preferably the temperature is between 50° and 90° C., more preferably between 70° and 90° C. when water is used as the solvent.

The heat on the transfer surface can also cause a lowering of the viscosity of the chemical papermaking additive, thus increasing its ability to spread into a thin film on the transfer surface. This film is then transferred to the paper web surface by contacting the web with the transfer surface. Surprisingly, it has been found that the chemical papermaking additive transfer efficiency to the web is quite high. Efficiencies on the order of 40 to 80% are typical, based on the flow out of the spray nozzles to the transfer surface and the quantity measured on the paper web. Moreover, this process is not limited to overdried paper. Depending on the amount of water removed from the spray mixture by the hot transfer surface, the process described herein is capable of delivering chemical papermaking additives to equilibrated dry paper as well. However application to a hot overdried web is preferred, to insure that any residual water in the film does not interfere with any paper properties.

An additional benefit in applying the chemical papermaking additive solution to a hot overdried web is that the decreased viscosity of the solution aids in insuring that the solution is uniformly applied across the surface of the web. (It is believed that the low viscosity solution is more mobile).

CHEMICAL PAPERMAKING ADDITIVES

The chemical papermaking additives for use in the improved process of the present invention are preferably selected from the group consisting of strength additives, absorbency additives, softener additives, aesthetic additives, and mixtures thereof. Each of these types of additives will be discussed below.

A) Strength Additives

The strength additive is selected from the group consisting of permanent wet strength resins, temporary wet strength resins, dry strength additives, and mixtures thereof.

If permanent wet strength is desired, the chemical papermaking additive can be chosen form the following group of chemicals: polyamid-epichlorohydrin, polyacrylamides, styrene-butadiene latexes; insolubilized polyvinyl alcohol; urea-formaldehyde; polyethyleneimine; and chitosan polymers. Polyamide-epichlorohydrin resins are cationic wet strength resins which have been found to be of particular utility. Suitable types of such resins are described in U.S. Pat. Nos. 3,700,623, issued on Oct. 24, 1972, and 3,772,076, issued on Nov. 13, 1973, both issued to Keim and both being hereby incorporated by reference. One commercial source of a useful polyamide-epichlorohydrin resins is Hercules, Inc. of Wilmington, Del., which markets such resin under the mark Kymeme TM 557H.

Polyacrylamide resins have also been found to be of utility as wet strength resins. These resins are described in U.S. Pat. Nos. 3,556,932, issued on Jan. 19, 1971, to Coscia, et al. and 3,556,933, issued on Jan. 19, 1971, to Williams et al., both patents being incorporated herein by reference. One commercial source of polyacrylamide resins is American Cyanamid Co. of Stanford, Conn., which markets one such resin under the mark Parez TM 631 NC.

Still other water-soluble cationic resins finding utility in this invention are urea formaldehyde and melamine formaldehyde resins. The more common functional groups of these polyfunctional resins are nitrogen containing groups such as amino groups and methylol groups attached to nitrogen. Polyethylenimine type resins may also find utility in the present invention.

If temporary wet strength is desired, the chemical papermaking additive can be chosen form the following group of chemicals. Cationic dialdehyde starch-based resin (such as Caldas produced by Japan Carlet or Cobond 1000 produced by National Starch); dialdehyde starch; and/or the resin described in U.S. Pat. No. 4,981,557 issued on Jan. 1, 1991, to BJorkquist and incorporated herein by reference.

If dry strength is desired ,the chemical papermaking additive can be chosen from the following group of chemicals. Polyacrylamide (such as combinations of Cypro 514 and Accostrength 711 produced by American cyanamid of Wayne, N.J.); starch (such as corn starch or potato starch); polyvinyl alcohol (such as Airvol 540 produced by Air Products Inc. of Allentown, Pa.); guar or locust bean gums; polyacrylate latexes; and/or carboxymethyl cellulose (such as Aqualon CMC-T from Aqualon Co., Wilmington, Del.). In general, suitable starch for practicing the present invention is characterized by water solubility, and hydrophilicity. Exemplary starch materials include corn starch and potato starch, albeit it is not intended to thereby limit the scope of suitable starch materials; and waxy corn starch that is known industrially as amioca starch is particularly preferred. Amioca starch differs from common corn starch in that it is entirely amylopectin, whereas common corn starch contains both amplopectin and amylose. Various unique characteristics of amioca starch are further described in "Amioca - The Starch From Waxy Corn", H H. Schopmeyer, Food Industries, Dec. 1945, pp. 106–108 (Vol. pp. 1476–1478). The starch can be in granular or dispersed form albeit granular form is preferred. The starch is preferably sufficiently cooked to induce swelling of the granules More preferably, the starch granules are swollen, as by cooking, to a point just prior to dispersion of the starch granule. Such highly swollen starch granules shall be referred to as being "fully cooked." The conditions for dispersion in general can vary depending upon the size of the starch granules, the degree of crystallinity of the granules, and the amount of amylose present. Fully cooked amioca starch, for example, can be prepared by heating an aqueous slurry of about 4% consistency of starch granules at about 190° F. (about 88° C.) for between about 30 and about 40 minutes. Other exemplary starch materials which may be used include modified cationic starches such as those modified to have nitrogen containing groups such as amino groups and methylol groups attached to nitrogen, available from National Starch and Chemical Company, (Bridgewater, N.J.). Such modified starch materials have heretofore been used primarily as a pulp furnish additive to increase wet and/or dry strength. However, when applied in accordance with this invention by application to an overdried tissue paper web they may have reduced effect on wet strength relative to wet-end addition of the same modified starch materials. Considering that such modified starch materials are more expensive than unmodified starches, the latter have generally been preferred. These wet and dry strength resins may be added to the pulp furnish in addition to being added by the process described in this invention. It is to be understood that the addition of chemical compounds such as the wet strength and temporary wet strength resins discussed above to the pulp furnish is optional and is not necessary for the practice of the present development.

For purposes of this invention, the strength additive is preferably applied to the heated transfer roll in an aqueous solution. Methods of application include, the same previously described with reference to application of other chemical additives preferably by spraying; and, less preferably, by printing. The strength additive may be applied to the tissue paper web alone, simultaneously with, prior to, or subsequent to the addition of softener, absorbency, and/or aesthetic additives. At least an effective amount of a strength additive, preferably starch, to provide lint control and concomitant strength increase upon drying relative to a non-binder treated but otherwise identical sheet is preferably applied to the sheet. Preferably, between about 0.01% and about 2.0% of a strength additive is retained in the dried sheet, calculated on a dry fiber weight basis; and, more preferably, between about 0.1% and about 1.0% of a strength additive material, preferably starch-based, is retained.

B) Softener Additives

The chemical softener additives are selected from the group consisting of lubricants, plasticizers, cationic debonders, noncationic debonders and mixtures thereof. Debonders which are preferred for use in the present invention are noncationic; and, more preferably, are nonionic surfactants. However, cationic surfactants may be used. Noncationic surfactants include anionic, nonionic, amphoteric, and zwitterionic surfactants. Preferably, the surfactant is substantially nonmigratory in situ after the tissue paper has been manufactured in order to substantially obviate post-manufacturing changes in the tissue paper's properties which might otherwise result from the inclusion of surfactant. This may be achieved, for instance, through the use of surfactants having melt temperatures greater than the temperatures commonly encountered during storage, shipping, merchandising, and use of tissue paper product embodiments of the invention: for example, melt temperatures of about 50° C. or higher. Also, the surfactant is preferably water-soluble when applied to the wet web.

The level of noncationic surfactant applied to tissue paper webs to provide the aforementioned softness/tensile benefit ranges from the minimum effective level needed for imparting such benefit, on a constant tensile basis for the end product, to about 2%: preferably between about 0.01% and about 2% noncationic surfactant is retained by the web; more preferably, between about 0.05% and about 1.0%; and, most preferably, between about 0.05% and about 0.3%. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta TM SL-40 which is available from Croda, Inc. (New York, N.Y.); alkylglycoside ethers as described in U.S. Pat. No. 4,011,389, issued to W. K. Langdon, et al. on Mar. 8, 1977; alkylpolyethoxylated esters such as Pegosperse TM 200 ML available from Glyco Chemicals, Inc. (Greenwich, Conn.); alkylpolyethoxylated ethers and esters such as Neodol® 25-12 available from Shell Chemical Co; sorbitan esters such as Span 60 from ICI America, Inc, ethoxylated sorbitan esters, propoxylated sorbitan esters, mixed ethoxylated/propoxylated sorbitan esters, and polyethoxylated sorbitan alcohols such as Tween 60 also from ICI America, Inc. Alkylpolyglycosides are particularly preferred for use in the present invention. The above listings of exemplary surfactants are intended to be merely exemplary in nature, and are not meant to limit the scope of the invention.

The surfactant may be applied to the hot transfer surface by spraying, gravure printing, or flexographic printing. Any surfactant other than the chemical papermaking additive emulsifying surfactant material, is hereinafter referred to as "surfactant," and any surfactant present as the emulsifying component of emulsified chemical papermaking additives is hereinafter referred to as "emulsifying agent". The surfactant may be applied to the tissue paper alone or simultaneously with, after, or before other chemical papermaking additives. In a typical process, if another additive is present, the surfactant is applied to an overdried web simultaneously with the other additive(s). It may also be desirable to treat a debonder containing tissue paper with a relatively low level of a binder for lint control and/or to increase tensile strength. As used herein the term "binder" refers to the various wet and dry strength additives known in the art. The binder may be applied to the tissue paper simultaneously with, after or before the debonder and an absorbency aid, if used. Preferably, binders are added to the overdried tissue webs simultaneously with the debonder (i.e., the binder is included in the dilute debonder solution applied to the heated transfer surface).

If a chemical softener that functions primarily by imparting a lubricous feel is desired, it can be chosen from the following group of chemicals. Organic materials (such as mineral oil or waxes such as parafin or carnuba, or lanolin); and polysiloxanes (such as the compounds described in U.S. Pat. No. 5,059,282 issued to Ampulski and incorporated herein by reference). It has been found, surprisingly, that low levels of polysiloxane applied to hot, overdried tissue paper webs can provide a softened, silky, flannel-like, nongreasy tactile sense of feel to the tissue paper without the aid of additional materials such as oils or lotions. Importantly, these benefits can be obtained for many of the embodiments of the present invention in combination with high wettability within the ranges desirable for toilet paper application. Preferably, tissue paper treated with polysiloxane in accordance with the present invention comprises about 0.75% or less polysiloxane. It is an unexpected benefit of this invention that tissue paper treated with about 0.75% or less polysiloxane can have imparted thereto substantial softness and silkiness benefits by such a low level of polysiloxane. In general, tissue paper having less than about 0.75% polysiloxane, preferably less than about 0.5%, can provide substantial increases in softness and silkiness and flannel-like quality yet remain sufficiently wettable for use as toilet paper without requiring the addition of surfactant to offset any negative impact on wettability which results from the polysiloxane.

The minimum level of polysiloxane to be retained by the tissue paper is at least an effective level for imparting a tactile difference in softness or silkiness or flannel-like quality to the paper. The minimum effective level may vary depending upon the particular type of sheet, the method of application, the particular type of polysiloxane, and whether the polysiloxane is supplemented by starch, surfactant, or other additives or treatments. Without limiting the range of applicable polysiloxane retention by the tissue paper, preferably at least about 0.004%, more preferably at least about 0.01%, and most preferably at least about 0.05% polysiloxane is retained by the tissue paper. Preferably, a sufficient amount of polysiloxane to impart a tactile sense of softness is disposed uniformly on both surfaces of the tissue paper: i.e., disposed on the outwardly facing surfaces of the surface-level fibers. When polysiloxane is applied to one surface of the tissue paper, some of it will, generally, at least partially penetrate to the tissue paper interior. However, preferably, the polysiloxane is applied to both sides of the tissue paper to ensure that both surfaces have imparted thereto the benefits of the polysiloxane. In addition to treating tissue paper with polysiloxane as described above, it has been found desirable to also treat such tissue paper with an absorbency additive. This is in addition to any surfactant material that may be present as an emulsifying agent for the polysiloxane. In some cases it has also been found desirable to omit the polysiloxane from the additive solution and to treat tissue paper with surfactant material alone to improve wetting and/or softness. Tissue paper having in excess of about 0.3% polysiloxane is preferably treated with surfactant when contemplated for uses wherein high wettability is desired. Most preferably, a noncationic surfactant is applied to the hot, overdried tissue paper web, in order to obtain an additional softness benefit, on a constant tensile basis, as previously discussed. The amount of surfactant required to increase hydrophilicity to a desired level will depend upon the type and level of polysiloxane and the type of surfactant. However, as a general guideline, between about 0.01% and about 2% surfactant retained by the tissue paper, preferably between about 0.05% and about 1.0%, is believed to be sufficient to provide sufficiently high wettability for most applications, including toilet paper, for polysiloxane levels of about 0.75% or less.

If a chemical softener that functions primarily by plasticizing the structure is desired, it can be chosen from the following group of chemicals: polyethylene glycol (such as PEG 400); dimethylamine; and/or glycerine.

If a cationic chemical softener that functions primarily by debonding is desired, it can be chosen from the following group of chemicals. Cationic quaternary compounds (such as dihydrogenated tallow dimethyl ammonium methyl sulfate (DTDMAMS) or dihydrogenated tallow dimethyl ammonium chloride (DTDMAC) both produced by Sherex Corporation of Dudlin, Oh.; Berocel 579 (produced by Eka Nobel of Stennungsund, Sweden); materials described in U.S. Pat. Nos. 4,351,699 and 4,447,294 issued to Osborn and incorporated herein by reference; and/or diester derivitives of DTDMAMS or DTDMAC.)

C) Absorbency Additives

If an absorbency aid is desired that enhances the rate of absorbency it can be chosen from the following group of chemicals: polyethoxylates (such as PEG 400); alkyl ethoxylated esters (such as Pegosperse 200 ML from Lonza Inc.); alkyl ethoxylated alcohols (such as Neodol®); alkyl polyethoxylated nonylphenols (such as Igepal CO produced by Rhone-Poulenc/GAF) and/or materials described in U.S. Pat. No's. 4,959,125 and 4,940,513 issued to Spendel and incorporated herein by reference. In those instances where the surfactant debonder softener decreases wetting, a wetting agent, e.g., a second surfactant, may be added to the application solution. For example, a sorbitan stearate ester can be mixed with an alkyl polyethoxylated alcohol to produce a soft wettable paper.

If an absorbency aid is desired that decreases the rate of absorbency it can be chosen from the following group of chemicals. Alkylketenedimers (such as Aquapel® 360XC Emulsion manufactured by Hercules Inc., Wilmington, Del.); fluorocarbons (such as Scotch Guard by 3M of Minneapolis, Minn.).

The absorbency additive can be used alone or in combination with a strength additive. Starch based strength additives have been found to be the preferred binder for use in the present invention. Preferably, the tissue paper is treated with an aqueous solution of starch, and, as mentioned above, the sheet is overdried at the time of application. In addition to reducing linting of the finished tissue paper product, low levels of starch also imparts a modest improvement in the tensile strength of tissue paper without imparting boardiness (i.e., stiffness) which would result from additions of high levels of starch. Also, this provides tissue paper having improved strength/softness relationship compared to tissue paper which has been strengthened by traditional methods of increasing tensile strength: for example, sheets having increased tensile strength due to increased refining of the pulp; or through the addition of other dry strength additives. This result is especially surprising since starch has traditionally been used to build strength at the expense of softness in applications wherein softness is not an important characteristic: for example, paperboard. Additionally, parenthetically, starch has been used as a filler for printing and writing paper to improve surface printability.

D) Aesthetic Additives

If an aesthetic additive is desired, it can be chosen from the following group of chemicals. inks; dyes; perfumes; opacifiers (such as TiO2 or calcium carbonate), optical brighteners, and mixtures thereof.

The aesthetics of the paper can also be improved utilizing the process described in this invention. Inks, dyes, and/or perfumes are preferably added to the application fluid which is subsequently applied to the hot transfer roll. The aesthetics additive may be applied alone or in combination with the wetting, softening, and/or strength additives.

Analytical Methods

Analysis of the amounts of treatment chemicals herein retained on tissue paper webs can be performed by any method accepted in the applicable art. For example, the level of polysiloxane retained by the tissue paper can be determined by solvent extraction of the polysiloxane with an organic solvent followed by atomic absorption spectroscopy to determine the level of silicon in the extract; the level of nonionic surfactants, such as alkylglycosides, can be determined by extraction in an organic solvent followed by gas chromatography to determine the level of surfactant in the extract; the level of anionic surfactants, such as linear alkyl sulfonates, can be determined by water extraction followed by colorimetry analysis of the extract; the level of starch can be determined by amylase digestion of the starch to glucose followed by colorimetry analysis to determine glucose level. These methods are exemplary, and are not meant to exclude other methods which may be useful for determining levels of particular components retained by the tissue paper.

Hydrophilicity of tissue paper refers, in general, to the propensity of the tissue paper to be wetted with water. Hydrophilicity of tissue paper may be somewhat quantified by determining the period of time required for dry tissue paper to become completely wetted with water. This period of time is referred to as "wetting time." In order to provide a consistent and repeatable test for wetting time, the following procedure may be used for wetting time determinations: first, a conditioned sample unit sheet (the environmental conditions for testing of paper samples are 23°±1° C. and 50-2% RH as specified in TAPPI Method T 402), approximately $4\frac{3}{8}$ inch × $4\frac{3}{4}$ inch (about 11.1 cm × 12 cm) of tissue paper structure is provided; second, the sheet is folded into four (4) juxtaposed quarters, and then crumpled into a ball approximately 0.75 inches (about 1.9 cm) to about 1 inch (about 2.5 cm) in diameter; third, the balled sheet is placed on the surface of a body of distilled water at 23°±1° C. and a timer is simultaneously started; fourth, the timer is stopped and read when wetting of the balled sheet is completed. Complete wetting is observed visually.

The preferred hydrophilicity of tissue paper depends upon its intended end use. It is desirable for tissue paper used in a variety of applications, e.g., toilet paper, to completely wet in a relatively short period of time to prevent clogging once the toilet is flushed. Preferably, wetting time is 2 minutes or less. More preferably, wetting time is 30 seconds or less. Most preferably, wetting time is 10 seconds or less.

Hydrophilicity characters of tissue paper embodiments of the present invention may, of course, be determined immediately after manufacture. However, substantial increases in hydrophobicity may occur during the first two weeks after the tissue paper is made: i.e., after the paper has aged two (2) weeks following its manufacture. Thus, the above stated wetting times are preferably measured at the end of such two week period. Accordingly, wetting times measured at the end of a two week aging period at room temperature are referred to as "two week wetting times."

The density of tissue paper, as that term is used herein, is the average density calculated as the basis weight of that paper divided by the caliper, with the appropriate unit conversions incorporated therein. Caliper of the tissue paper, as used herein, is the thickness of the paper when subjected to a compressive load of 95 $g/in^2$ (15.5 $g/cm^2$).

EXAMPLE I

The purpose of this example is to illustrate one method that can be used to make soft tissue paper sheets treated with a softening additive in accordance with the present invention.

A pilot scale Fourdrinier papermaking machine is used in the practice of the present invention. The paper machine has a layered headbox having a top chamber, a center chamber, and a bottom chamber. Where applicable as indicated in the following examples, the procedure described below also applies to such later examples. Briefly, first a fibrous slurry comprised primarily of short papermaking fibers is pumped through the top and bottom headbox chambers and, simultaneously, a second fibrous slurry comprised primarily of long papermaking fibers is pumped through the center headbox chamber and delivered in superposed relation onto the Fourdrinier wire to form thereon a three-layer embryonic web. The first slurry has a fiber consistency of about 0.11% and its fibrous content is Eucalyptus Hardwood Kraft. The second slurry has a fiber consistency of about 0.15% and its fibrous content is Northern Softwood Kraft. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The embryonic wet web is transferred from the Fourdrinier wire, at a fiber consistency of about 22% at the point of transfer, to a carrier fabric having a 5-shed satin weave, 35 machine-direction and 33 cross-machine-direction monofilaments per inch, respectively. The web is carried on the carrier fabric past the vacuum dewatering box, through the blow-through predryers after which the web is transferred onto a Yankee dryer. The fiber consistency is about 27% after the vacuum dewatering box and, by the action of the predryers, about 65% prior to transfer onto the Yankee dryer; creping adhesive comprising a 0.25% aqueous solution of polyvinyl alcohol is spray applied by applicators; the fiber consistency is increased to an estimated 99% before dry creping the web with a doctor blade. The doctor blade has a bevel angle of about 24 degrees and is positioned with respect to the Yankee dryer to provide an impact angle of about 83 degrees; the Yankee dryer is operated at about 350° F. (177° C.); the Yankee dryer is operated at about 800 fpm (feet per minute) (about 244 meters per minute). The heated calender rolls are sprayed with a chemical softener emulsion, further described below, using a 2 mm spray nozzle. The web is then passed between the two heated calender rolls. The two calender rolls are biased together at roll weight and operated at surface speeds of 660 fpm (about 201 meters per minute).

The spray solution is made by diluting Neodol® 25-12 Shell Chemical to 5% by weight with water. The surfactant solution is then sprayed onto a heated steel calender roll. The volumetric flow rate of the aqueous solution through the nozzle is about 2 gal/hr cross-direction ft (about 25 liters/hr-meter).

Greater than about 95% of the water is evaporated from the calender rolls leaving a calculated chemical softener film thickness of less than 0.07 microns. The dry web, which has a moisture content of about 1%, contacts the hot calender rolls. The chemical softener compound is transferred to the dry web by direct pressure transfer. The transfer efficiency of the chemical softener applied to the web, in general, is about 45%.

The resulting tissue paper has a basis weight of $30g/m^2$, a density of 0.10g/cc, and contains 0.17% by weight, of the alkylpolyethoxylated alcohol compound and has an unequilibrated initial moisture content of 1.2%. Importantly the resulting tissue paper has an improved tactile sense of softness relative to the untreated control.

EXAMPLE II

The purpose of this example is to illustrate one method that can be used to make soft tissue paper sheets wherein the tissue paper is treated with a softening additive and starch.

A 3-layer paper sheet is produced in accordance with the hereinbefore described process of Example 1. The tissue web is treated with Crodesta TM SL-40 (an alkyl glycoside polyester nonionic surfactant marketed by Croda Inc.) and with a fully cooked amioca starch prepared as described in the specification. The surfactant and starch are applied simultaneously on the heated transfer roll as part of the aqueous solution sprayed through the paper machine spray nozzle. Concentration of the Crodesta TM SL-40 nonionic surfactant in the aqueous solution is adjusted so that the level of surfactant retained is about 0.15%, based upon the weight of the dry fibers. Similarly, concentration of the starch in the aqueous solution is adjusted so that the level of amioca starch retained is about 0.2%, based upon the weight of the dry fibers.

The treating mixture is sprayed onto an upper and a lower heated transfer roll. The water is evaporated from the rolls and the active surfactant, and binder are transferred to both sides of the tissue web. The volumetric flow rate through the upper and lower spray nozzle onto the heated rolls is about 1 gal/hr cross-direction ft. The combined flow rate through both nozzles is 2 gal/hr cross-direction ft.

The resulting tissue paper has a basis weight of $3Og/m^2$, a density of 0.10g/cc, and contains 0.15% by weight of Crodesta TM SL-40 nonionic surfactant and 0.2% by weight of the cooked amioca starch. Importantly, the resulting tissue paper has enhanced tactile softness and has higher wettability and lower propensity for lint than untreated tissue paper.

EXAMPLE III

The purpose of this example is to illustrate one method that can be used to make soft tissue paper sheets wherein the tissue paper is treated in accordance with the present invention and converted into a two ply product.

A 2-layer paper sheet is produced in accordance with the hereinbefore described process of Example I with the following exceptions. The volumetric flow rate through the nozzle is approximately 1.05 gal/hr cross-direction foot (about 13.3 liters/hr-meter). The film thickness after 95% of the water is evaporated is calculated to about 0.035 microns. The resulting single ply tissue paper has a basis weight of 16 g/m$^2$.

Following papermaking, two sheets of treated paper are combined together with the treated surfaces facing outward.

The resulting two-ply tissue paper product has a basis weight of 32 g/m$^2$, a density of 0.10 g/cc, and contains 0.17% by weight, of the alkylpolyethoxylated alcohol.

Importantly, the resulting tissue paper has enhanced tactile softness.

EXAMPLE IV

The purpose of this example is to illustrate one method that can be used to make soft tissue paper sheets wherein the tissue paper is treated with a mixed surfactant system containing a softener additive and an absorbency enhancing agent. A 3-layer paper sheet is produced in accordance with the hereinbefore described process of Example I. An aqueous dispersion of softener is prepared from 11.9% GLYCOMUL-S CG (a mixed sorbitan stearate ester surfactant made by Lonza, Inc.), 3.2% Neodol ® 23-6.5T (an ethoxylated $C_{12}$–$C_{13}$ linear alcohol dispersing surfactant and wetting agent made by Shell Chemical Company), 0.8% DOW 65 Additive (a silicone polymer foam suppressant made by Dow Corning Corporation), and 84.1% distilled water.

The treating mixture is sprayed onto a lower heated calender (transfer) roll. The water is evaporated from the roll and the active softener and absorbency enhancing agent are transferred to one side of the tissue web. The flow rate through the spray nozzles is adjusted such that about 0.6% softener (Glycomul-S CG) is retained by the sheet. The resulting tissue paper has a basis weight of 30g/m$^2$, a density of 0.10g/cc, and contains about 0.6% by weight of the Glycomul-S CG surfactant. Importantly, the resulting tissue paper has an enhanced tactile softness and has high wettability.

EXAMPLE V

The purpose of this example is to illustrate one method that can be used to make soft tissue paper sheets wherein the tissue paper is treated with a biodegradable quaternized amine-ester softening compound. A 3-layer paper sheet is produced in accordance with the hereinbefore described process of Example I. A 1% aqueous dispersion of softener is prepared from a mixture of diester dihydrogenated tallow dimethyl ammonium chloride (DEDTDMAC) (i.e., ADOGEN DDMC from the Sherex Chemical Company) and a polyethylene glycol wetting agent (i.e., PEG-400 from the Union Carbide Company). The solution is prepared according to the following procedure: 1. An equivalent molar concentration of DEDTDMAC and PEG-400 is weighed; 2. PEG is heated up to about 180° F.; 3. DEDTDMAC is dissolved into PEG to form a melted solution; 4. Shear stress is applied to form a homogeneous mixture of DEDTDMAC in PEG; 5. The pH of the dilution water is adjusted to about 3 by the addition of hydrochloric acid; 6. The dilution water is then heated up to about 180° F.; 7. The melted mixture of DEDTDMAC/PEG400 is diluted to a 1% solution; 8. Shear stress is applied to form an aqueous solution containing a vesicle suspension of DEDTDMAC/PEG-400 mixture.

The treating mixture is sprayed onto a lower heated calender (transfer) roll. The water is evaporated from the roll and the active softening compound and absorbency agent are transferred to one side of the tissue web. The flow rate through the spray nozzles is adjusted such that about 0.05% softener (DEDTDMAC) is retained by the sheet. The resulting tissue paper has a basis weight of 30g/m$^2$, a density of 0.10g/cc, and contains about 0.05% by weight of the DEDTDMAC softener. Importantly, the resulting tissue paper has an enhanced tactile softness and has high wettability.

What is claimed is:

1. A process for applying chemical papermaking additives to a dried and creped tissue paper web, said process comprising the steps of:

a) providing a dried and creped tissue paper web;

b) diluting a chemical papermaking additive with a suitable solvent to form a dilute chemical solution;

c) applying said dilute chemical solution to a heated transfer surface, wherein said heated transfer surface is a hot calender roll;

d) evaporating at least a portion of said solvent from said hot calender roll to form a film containing said chemical papermaking additive; and e) transferring said film from said hot calender roll to at least one outwardly-facing surface of said dried and creped tissue web by contacting said outwardly-facing web surface with said hot calender roll, thereby transferring a sufficient amount of said chemical papermaking additive such that from about 0.004% to about 2.0% of said chemical papermaking additive, based on the dry fiber weight of said tissue web, is retained by said tissue web;

wherein said chemical papermaking additive is selected from the group consisting of strength additives, absorbancy additives, softener additives, and mixtures thereof.

2. The process of claim 1 wherein the solvent in step (b) is water.

3. The process of claim 1 wherein said chemical papermaking additive is a softener additive.

4. The process of claim 3 wherein said softener additive is selected from the group consisting of lubricants, plasticizers, cationic debonders, noncationic debonders, and mixtures thereof.

5. The process of claim 4 wherein said softener additive is a noncationic debonder.

6. The process of claim 5 wherein said noncationic debonder is selected from the group consisting of sorbitan esters, ethoxylated sorbitan esters, propoxylated sorbitan esters, mixed ethoxylated/propoxylated sorbitan esters, and mixtures thereof.

7. The process of claim 1 wherein said chemical papermaking additive is a strength additive.

8. The process of claim 7 wherein said strength additive is selected from the group consisting of permanent wet strength resins, temporary wet strength resins, dry strength additives, and mixtures thereof.

9. The process of claim 8 wherein said strength additive is a permanent wet strength resin selected from the group consisting of polyamide-epichlorohydrin resin, polacrylamide resin, and mixtures thereof.

10. The process of claim 8 wherein said strength additive is a starch-based temporary wet strength resin.

11. The process of claim 1 wherein said chemical papermaking additive is an absorbancy additive.

12. The process of claim 13 wherein said absorbancy additive is selected from the group consisting of polyethoxylates, alkylethoxylated esters, alkylethoxylated alcohols, alkylpolyethoxylated nonylphenols, and mixtures thereof.

13. The process of claim 14 wherein said absorbancy additive is an alkyl ethoxylated alcohol.

14. The process of claim 6 further comprising the step of applying to said web, a sufficient amount of an absorbancy additive such that from about 0.01% to about 2.0% of said absorbancy additive, based on the dry fiber weight of said tissue paper, is retained by said web.

15. The process of claim 14 wherein said absorbency additive is a nonionic surfactant.

16. The process of claim 15 wherein said nonionic surfactant has a melting point of at least about 50° C.

17. The process of claim 15 wherein said nonionic surfactant is an alkylethoxylated alcohol.

18. The process of claim 3 further comprising the step of applying to said web a sufficient amount of a strength additive such that from about 0.01% to about 2.0% of said strength additive, based on the dry fiber weight of said tissue paper, is retained by said web.

19. The process of claim 18 wherein said strength additive is a starch-based temporary wet strength resin.

20. The process of claim 14 further comprising the step of applying to said web a sufficient amount of a strength additive such that from about 0.01% to about 2.0% of said strength additive, based on the dry fiber weight of said tissue paper, is retained by said web.

21. The process of claim 20 wherein said absorbancy additive is a nonionic surfactant and wherein said strength additive is a starch-based temporary wet strength resin.

* * * * *

UNITED STATES PATENT AND TRADEMARK OFFICE

CERTIFICATE OF CORRECTION

PATENT NO. : 5,246,545

DATED : September 21, 1993

INVENTOR(S) : Robert S. Ampulski, Paul D Trokhan

It is certified that error appears in the above-indentified patent and that said Letters Patent is hereby corrected as shown below:

Column 1, line 30 "top" should read --to--.

Column 1, line 39 insert after "foraminous" --screen--.

Column 2, line 61 insert after "surface" --.--.

Column 4, line 35 insert after "additive" --.--.

Column 4, line 54 insert after "creped" --.--.

Column 5, line 59 "o " should read --of--.

Column 15, line 56 "BJ" should read --Bj--.

Column 20, line 59 "50-2" should read --50±2--.

Signed and Sealed this

Fifth Day of March, 1996

*Attest:*

Bruce Lehman

BRUCE LEHMAN

*Attesting Officer*

*Commissioner of Patents and Trademarks*